US006340430B1

(12) United States Patent
Wood

(10) Patent No.: US 6,340,430 B1
(45) Date of Patent: Jan. 22, 2002

(54) DISTILLATE DEWAXING PROCESS

(75) Inventor: Brian Murray Wood, Glenview, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/397,350

(22) Filed: Sep. 15, 1999

(51) Int. Cl.[7] ..... C10G 45/00

(52) U.S. Cl. ..... 208/89; 208/59; 208/57; 208/114; 208/109

(58) Field of Search ..... 208/89, 59, 57, 208/114, 18

(56) References Cited

U.S. PATENT DOCUMENTS 4,913,797 A * 4/1990 Albinson et al. ..... 208/89

4,917,789 A * 4/1990 Baker et al. ..... 208/89

* cited by examiner

*Primary Examiner*—Helane E. Myers
(74) *Attorney, Agent, or Firm*—John G. Tolomei; John F. Spears, Jr.

(57) ABSTRACT

A hydrotreating process is presented for both dewaxing the diesel fraction and reducing the aromatic content of kerosene fraction of a distillate boiling range feed stream. The feed stream is flashed to generate vapor and liquid phase streams. The portion which comprises most of the heavy diesel is passed into a dewaxing zone. The vapor-phase stream, preferably rich in kerosene and light diesel, is used to quench the effluent of the dewaxing zone before it is passed into a downstream aromatics hydrogenation zone. Depending on the composition of the feed to the process, a second flashing step performed in the presence of added hydrogen may be employed to produce the feed to the dewaxing zone. PNA's may be hydrogenated prior to recycling to a hydrocracking zone.

11 Claims, 1 Drawing Sheet

DISTILLATE DEWAXING PROCESS

FIELD OF THE INVENTION

The invention relates to a hydrocarbon conversion process for use in petroleum refineries. The invention more specifically relates to a novel hydrotreating process flow scheme intended to simultaneously improve the cold flow properties of diesel fuel and to reduce the aromatic hydrocarbon content of jet fuel and diesel boiling range components of a single broad boiling point range feed. Such processes are referred to as catalytic hydrodewaxing and aromatics saturation processes.

RELATED ART

Hydrotreating processes are used commercially in a large number of petroleum refineries. They are used to process a variety of multicomponent feeds ranging from light naphthas to very heavy crude oil residual fractions. In general the hydrotreating processes improve the quality of the material being processed as by increasing the hydrogen to carbon ratio of the materials or by removing sulfur and nitrogen. The significant economic utility of hydrotreating processes has resulted in a large amount of developmental effort being devoted to the improvement of these processes and to the development of better catalysts for use in the processes.

U.S. Pat. No. 4,917,789 issued to J. R. Butler et al. describes a hydrotreating process which involves sequential desulfurization and dewaxing.

U.S. Pat. No. 3,539,495 issued to C. J. Egan shows an overall refinery flow comprising a hydrocracking step, fractionation and passage of waxy distillate into a two-stage hydrotreating zone which performs dewaxing.

U.S. Pat. No. 4,818,369 issued to R. W. Bortz describes a distillate dewaxing process in which the distillate is passed through a catalytic dewaxing reactor and a hydrotreating reactor in series.

U.S. Pat. No. 4,880,760 issued to R. J. Pellet et al. teaches that hydrocarbon feedstocks can be catalytically hydrodewaxed using a catalyst comprising a nonzeolitic molecular sieve (NZMS). This patent describes the composition and synthesis of a variety of NZMS materials including SAPO and MgAPSO molecular sieves. U.S. Pat. No. 4,793,984 issued to B. M. Lok et al. gives descriptions of NZMS materials including MgAPSO molecular sieves and a generalized description of their use in such processes as hydrofining and hydrocracking.

U.S. Pat. Nos. 4,859,312; 4,921,594 and 5,149,421 issued to S. J. Miller describe the use of a dewaxing catalyst comprising a silicoaluminophosphate (SAPO) molecular sieve and a metal hydrogenation component to treat heavier feedstocks such as middle distillates.

SUMMARY OF THE INVENTION

The invention is an integrated hydrotreating process in which a distillate feed stream is first separated into light and heavy middle-distillate boiling range fractions recovered as vapor and liquid fractions respectively. The heavy fraction comprising most of the heavy diesel is passed into a catalytic dewaxing zone while the other fraction is used to quench the effluent of the dewaxing zone to prepare it for processing in a lower temperature aromatics saturation zone.

One embodiment of the invention comprises separating, in a first vapor/liquid separation zone in the presence of added hydrogen as required to obtain the desired separation, a distillate hydrocarbon fraction into a first vapor phase process stream comprising hydrocarbons boiling in the light diesel and kerosene boiling point ranges and a first liquid phase process stream comprising hydrocarbons boiling in the heavy diesel boiling point range; passing the first liquid phase process stream into a catalytic dewaxing zone operated at catalytic hydrodewaxing conditions and thereby producing a catalytic dewaxing zone effluent stream; admixing the first vapor phase process stream and the catalytic dewaxing zone effluent stream and producing a charge mixture having a lower temperature than the catalytic dewaxing zone effluent stream; passing said charge mixture into an aromatic hydrocarbon saturation zone operated at hydrogenation conditions which include a lower temperature than said catalytic hydrodewaxing conditions, and recovering a distillate product stream having a lower pour point and reduced aromatics content than said distillate hydrocarbon fraction.

DETAILED DESCRIPTION AND PREFERRED EMBODIMENTS

Figure 1:
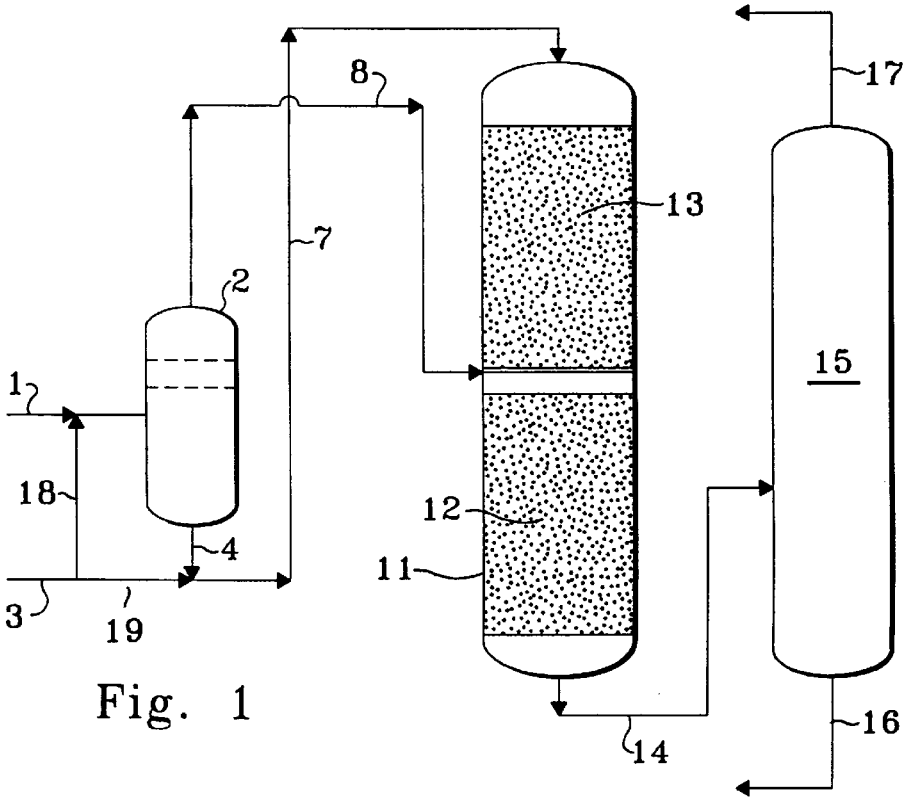
FIG. 1 is simplified flowscheme of the subject process applied to hydrotreated straight-run or cracked middle distillates and employing a single vapor/liquid separation vessel 2 to separate the feed into a light and heavy middle distillate fractions.

Catalytic hydrotreating processes to upgrade middle distillates are employed commercially and are being constantly improved. These processes seek to improve the quality of fuels and act in different ways to accomplish this task. For instance diesel fuel and gasoline may be improved by isomerization of straight-chain paraffins. This decreases the pour point of a diesel fuel and increases the octane number of a gasoline boiling range fuel. A different form of hydrotreating is used to remove sulfur and nitrogen to improve the quality of distillate fractions. Hydrocracking is an extreme form of hydrotreating employed to reduce the average molecular weight of a feed and convert it into more volatile high value productions.

Pour point improvement, often called dewaxing, is a primary function of the subject hydrotreating process. Pour point improvement can be beneficial in several ways. First, it can be used to improve the cold flow properties of diesel fuels, which become very critical in times of low temperature. Second, it can be used to increase the volume of heavy distillate hydrocarbons which a refinery may blend into a diesel fuel fraction while still meeting the cold flow specifications for diesel fuel. This increases the amount of diesel fuel the refinery can produce and increases the total value of the refinery's products. Catalytic dewaxing there has great utility in the refining industry. A second function of the subject process is aromatics hydrogenation. This is very beneficial in improving the quality of distillate products as measured by such tests as jet fuel "smoke point."

It is an objective of the invention to provide an improved process for hydrodewaxing middle distillates such as diesel fuel and jet fuel. It is a further objective of the subject invention to provide a more economical process for upgrading diesel and jet fuels.

The initial step in the subject process is the division of the overall process feed stream into a light fraction and a heavy fraction. One characteristic of this initial division of the process feed stream is that the entire stream is divided into just two fractions. These fractions become the feed streams for the two reaction zones. The separation zone(s) used for this may be simple stripping columns. However, the separation steps in the subject process can be performed in a number of different forms of vapor-liquid separators ranging from flash zones to fractionation columns. The use of the simplest equipment which will perform an adequate separation is preferred. A simple vapor-liquid separation vessel, with perhaps a few trays in its upper portion, is preferred. While effective, simple vapor-liquid separations at best provide a single stage of separation and are somewhat imprecise. Both the light and heavy (vapor and liquid) streams produced in a flash zone will therefore contain some compounds in the intended boiling point range of the other process stream. It is an objective to concentrate the heavier diesel fuel boiling range hydrocarbons, which will benefit the most from dewaxing, into the feed to the dewaxing zone. A total separation is not required.

The separation of the feed stream into the light and heavy fractions may be promoted or controlled in several ways which should be readily apparent. For instance the pressure in the vessel can be reduced or the operating temperature of the vessel can be increased to promote vaporization. As discussed below the addition of hydrogen is the preferred means of increasing vaporization.

The terms "light" and "heavy" are used herein in their normal sense within the refining industry to refer respectively to relatively low and high boiling point range portions of material boiling in the overall diesel boiling point range. The light and heavy diesel fractions will have average boiling points which differ by at least 40 F.°. These two fractions are created in the beginning of the process, preferably in low cost separation zones. This initial separation is distinguishable from the separation performed in a crude column on a full boiling range feed by the relatively limited boiling point range of the feed to the process. The feed stream to the subject process is equivalent to the feed to a conventional hydrocracking process and therefore has a limited boiling point range.

The subject invention is specific to the improvement (reduction) in the pour point of hydrocarbons within and just above the diesel fuel boiling range. The feed will consist primarily of hydrocarbonaceous compounds having boiling points above the naphtha boiling point range, which extends up to about 400° F. (204° C.). This may be expressed in terms of the 5% (vol.) boiling point of the feed stream as determined by the appropriate ASTM distillation procedure. The process feed stream should have a 5% boiling point above 350° F. (177° C.) and preferably above 400° F. (204° C.). Therefore substantially all (at least 90 vol. %) of the overall process feed stream will fall within the boiling point range between about 350° F. (177° C.) and 950° F. (510° C.). Preferably at least 50 vol. % of the process feed stream is diesel boiling range material. That is, it has a boiling point between 175 to 370° C. (350–700° F.). More preferably at least 70% of the feed boils in this broad range. Motor fuel diesels typically have a lower end point of about 350° C. or less.

Feedstocks can include fractions derived from virtually any heavy mineral or synthetic oil and fractions thereof. Thus, such feedstocks as straight run gas oils, vacuum gas oils, demetallized oils, coker distillates, cat cracker distillates, coal liquids and the like are contemplated. The preferred feedstock should not contain appreciable asphaltenes. The process feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %. It may also contain mono- and/or polynuclear aromatic compounds in amounts of 50 volume percent and higher.

The invention can be used to treat hydrocarbons boiling in just the diesel fuel boiling range fraction or an admixture of hydrocarbons overlapping this boiling range. For instance, as described in reference to FIG. 2, the feed may contain heavy materials which are not desired as feed components for the dewaxing zone. Such heavy materials are bypassed around the dewaxing zone. These include polynuclear aromatic compounds (PNA's) which have from about 3 to 8 benzene rings in their molecular structure. Other heavy hydrocarbonaceous compounds boiling above the diesel fuel boiling point range are also preferably bypassed around the dewaxing zone. Hydrogenation of the PNA's is beneficial in that it leads to their cracking in any subsequent pass through a hydrocracking zone. This can reduce the buildup of PNA's in the hydrocracking zone recycle stream.

The dewaxing zone is a treating zone rather than a conversion or cracking zone. The feed to the dewaxing zone may have a boiling point range extending from about 204° C. (400° F.) to about 400° C. (752° F.) and preferably from about 300° C. (572° F.) to about 400° C. (752° F.). The effluent from the dewaxing zone will preferably comprise an admixture of hydrocarbons having essentially the same boiling point range as the feed which enters the dewaxing zone. Only a small amount, less than 10%, conversion by cracking occurs in the dewaxing zone. The conversion which does occur will produce some lower boiling hydrocarbons but the majority of the feed preferably passes through the dewaxing zone with only a minor boiling point change. Most preferably less than 5% conversion occurs in the dewaxing zone. Such conversion is normally undesired in a dewaxing process as it reduces the yield of the intended middle distillate products. The term "conversion" as used herein refers to the chemical change necessary to allow the product hydrocarbons to be separated into a lighter (lower boiling) distillate recovered from the effluent of the process.

The operation of the subject process may be easily discerned from the drawing. The drawing presents simplified flowschemes showing the application of the subject invention to two feed streams of different composition. For the purpose of clarity of presentation, such normal and customary equipment as control valves, sensors, additional separation vessels, the quench streams to the midpoints of reaction zones and other supplemental systems are not illustrated on the drawing. In FIG. 1 a feedstream comprising hydrocarbons boiling primarily in the diesel and kerosene boiling point ranges enters the process through line 1. This feedstream has been previously heated by means not shown such that upon entrance into the vapor/liquid separation zone 2 the feedstream will to a large extent separate into a vapor fraction comprising mainly materials boiling in the kerosene and light diesel point ranges and a heavier liquid phase fraction. Hydrogen from line 18 is combined with feed stream 1 prior to passage into the separation zone 2, as required to obtain the desired separation in the vapor/liquid separation zone. The heavier, liquid phase stream is removed from the separation zone 2 and admixed with additional hydrogen from line 19. The hydrogen of line 3 can have a temperature sufficient to heat the liquid flowing into and from flash zone 2. However, it is preferred that an optional heating means not shown is employed to heat the admixture of hydrogen and hydrocarbons flowing through line 7 to the desired inlet temperature of a dewaxing zone located in the upper portion of reactor 11. It is also preferred that the hydrogen of line 3 is the total hydrogen charged to the two downstream reaction zones.

The heated admixture of hydrogen and heavy distillate boiling hydrocarbonaceous compounds therefore flows through line 7 into the upper end of the reactor 11 and is distributed by means not shown across an upper catalyst bed 13 containing the dewaxing catalyst. Contact of the entering hydrocarbonaceous compounds with hydrogen and the dewaxing catalyst results in isomerization, which tends to reduce the average viscosity of the hydrocarbonaceous compounds flowing downward through the dewaxing zone.

At the same time, the lighter vapor phase fraction separated from the feedstream in the flash vessel 2 is transferred through line 8 into an intermediate point of the reactor 11. The process stream of line 8 is used to quench the effluent of the dewaxing zone. The temperature of this stream is set by conditions in the separation zone, which are set by the optimum conditions to achieve the desired separation. It is preferred that it is not heated and it may even be cooled if desired. However, it may be necessary to heat the stream of line 8 to avoid overcooling the effluent of the dewaxing zone.

The process stream of line 8 is employed in the subject overall process as a quench stream which is admixed with the mixed phase materials exiting the bottom of the bed 13 of dewaxing catalyst present in the upper portion of the reactor 11. The admixture of these two fractions results in a combined feedstream having a lower temperature than the effluent of the dewaxing zone. This combined material is passed downward into a second catalyst bed 12 located in a lower portion of the reactor 11. The catalyst in this bed is selected for its ability to effect the saturation of aromatic hydrocarbons present in the combined admixture.

As previously noted, the invention improves the ability of this second catalyst to effect the desired hydrogenation reaction since the materials entering the second reaction zone are now at a lower temperature than is employed in the dewaxing zone. The admixture of hydrocarbonaceous compounds and hydrogen flows downward through the bed of aromatics saturation catalyst 12. The effluent of the aromatics hydrogenation catalyst is collected at the bottom of the reactor 11, cooled, and transferred through line 14 into a separation zone 15. This zone may comprise one or more fractionation columns. These columns can be located in an overall hydrocracking process. In zone 15, hydrogen and light hydrocarbons, which are formed as by-products or are present in the feed or hydrogen streams of line 1 and 3 respectively, are concentrated into a net overhead stream removed from the process in line 17. The combined middle-distillate boiling point range product is removed from the bottom of the separation zone 15 through line 16. Alternatively, if the feed to the subject process comprises hydrocracking zone effluent material including unconverted charge stock and PNA's then the stream of line 16 may be the recycle stream of the hydrocracking process.

The Drawing indicates a single reactor 11 is employed in this embodiment of the process. As an alternative, the dewaxing catalyst could be located in a separate reactor from the aromatics saturation catalyst. This is purely a matter of convenience and economics and is not a feature of the process flow of the subject invention.

FIG. 1 illustrates a space is left between the two catalyst beds to allow for the admixing of the quench stream of line 8 into the effluent of the dewaxing catalyst 13. Preferably some means is employed at this point to admix these two process streams and to distribute all of the liquid evenly over the top of aromatics saturation catalyst 12. A simple device such as a perforated grid could effect some admixing and distribution. However, it is preferred that a more effective device such as those shown in U.S. Pat. Nos. 5,635,145; 5,403,560; and, 5,462,719 is employed at this point.

A reaction zone effluent is typically heat exchanged with the feed to the reaction zone to recover heat and then passed into one or more vapor-liquid separation zones. Additional cooling can be done prior to this separation. The liquid recovered in this vapor-liquid separation zone is passed into a product recovery zone containing one or more fractionation columns. Product recovery methods for hydrotreating are well known and conventional methods may be employed in the subject invention.

The process designer has a limited number of variables to work with in order to achieve a desired separation of the feed stream of line 1. The two primary variables are temperature and pressure, but the feasibility and economics of changing these two variables limits the degree to which the separation can be varied using them. The subject process also employs the rate of hydrogen flow to the separation zone as a separate variable to approach the desired separation. On-line control as by a gas chromatograph can be used to regulate the amount of hydrogen flowing through line 18 in response to the composition of the vapor stream of line 8 or the liquid stream of line 7. As previously mentioned, line 3 preferably carries the entire hydrogen-rich gas flow, feed and recycle, to the overall reaction zone 11. The gas not passed into the separation zone 2 via line 8 is passed into the dewaxing section via line 19. A set minimum hydrogen flow is always passed through line 19.

Figure 2:
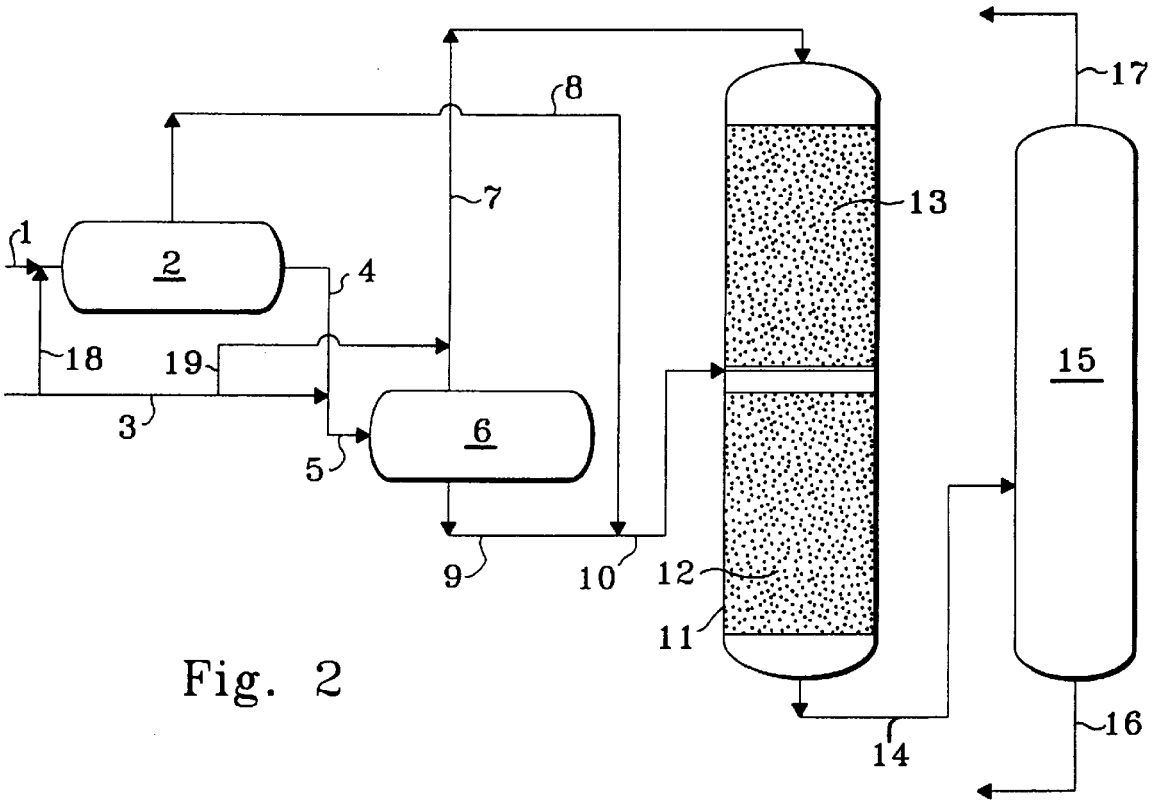
FIG. 2 shows a related flowscheme in which a feed comprising a hydrocracking unit stripper bottoms product 1 is separated into light and heavy fractions using two vapor/liquid separation zones 2 and 6 in series.

FIG. 2 illustrates the adaptation of the subject invention to the processing of a feed having a different composition. The feedstream of line 1 comprises the full stripper bottoms or liquid product recovered from an upstream hydrocracking zone. It is assumed that the feed and processing conditions of the hydrocracking zone result in the feedstream of line 1 containing some unconverted vacuum gas oil hydrocracking process chargestock. The feed will therefore contain such heavy materials as polynuclear aromatics, often referred to as PNA's. It is not desired to pass this heavy material into the catalytic dewaxing zone. Therefore a more complicated separation is performed.

Hydrogen from line 18 is first mixed with feed stream 1 as required to achieve the desired separation. The admixture is then passed into the vapor/liquid separation zone 2. The added hydrogen, the temperature of the feedstream of line 1, and any pressure decrease employed to aid separation results in the feedstream separating to form a vapor phase stream carried by line 8 comprising the kerosene and light diesel boiling range components of the feedstream of line 1. The unconverted vacuum gas oil material including any PNA's and the heavy diesel boiling range components of the feedstream of line 1 are concentrated primarily into a liquid phase stream removed from vapor/liquid separation zone 2 through line 4. In a manner similar to FIG. 1, part of the hydrogen to be passed into the reaction zone is carried by line 3 and admixed with the contents of line 4. The remainder of the hydrogen is passed through line 19 and into line 7.

The admixture of line 5 is passed into a second vapor/liquid separation zone 6. The temperature of the materials flowing through line 5, the pressure in the vapor/liquid separation zone 6 and the amount of added hydrogen are adjusted such that at least the majority of the heavy diesel boiling range hydrocarbonaceous compounds flowing through line 5 are concentrated into a vapor phase removed from vapor/liquid separation zone 6 through line 7. This second vapor phase process stream comprises a majority of the heavy diesel boiling range components of the feedstream 1 and is passed into the upper end of the reactor 11 in a manner similar to FIG. 1. That is, this is similar to the vapor/liquid separation zone of FIG. 1.

Despite the imprecise separation performed in the separation zone 6, a majority of the least volatile hydrocarbonaceous components of the feedstream, including PNA's, will be concentrated into a liquid fraction withdrawn from the separation zone 6 through line 9. This liquid fraction is combined with the vapor fraction of line 8 which contains the majority of the kerosene and light diesel boiling range materials present in the feedstream. The resultant admixture of these two fractions is then passed through line 10 into the reactor 11 as quench. In this manner, the heavy unconverted hydrocracking effluent material and PNA's bypass the dewaxing catalyst but is brought into contact with the aromatics hydrogenation catalyst. The remainder of the process flow is similar to that of FIG. 1. That is, the effluent of the aromatics saturation zone is transferred by line 14 into the separation zone 15 for hydrogen, by-product and product recovery. As previously mentioned, zone 15 can be within a hydrocracking complex and can comprise the product recovery section of a hydrocracking unit. Thus the saturation of the PNA's in the aromatics saturation bed of this invention would result in saturation of PNA's otherwise present in the recycle stream of the hydrocracking unit. The presence of PNA's, especially the heaviest PNA's, is deleterious to operation of hydrocracking units as they tend to "plate out" or deposit on cold surfaces such as heat exchangers.

Suitable catalysts for use in all reaction zones of this process are available commercially from several vendors including UOP, Haldor-Topsoe and Criterion Catalyst Company. The dewaxing catalyst may contain silicalite, MFI zeolites and silicoaluminophosphates (SAPOs). Dewaxing using SAPOs and other materials is described in some detail in U.S. Pat. Nos. 4,880,760; 4,859,311; 4,867,861; 4,877,581; 5,114,563 and 5,288,395. The teaching of these references in regard to catalyst compositions and operating conditions for dewaxing is incorporated herein.

A preferred dewaxing catalyst used in the subject process comprises a non-zeolitic molecular sieve (NZMS) material essentially free of Y zeolite. While some commercial catalysts contain a ZSM material, the dewaxing catalyst of the subject process is preferably free of molecular sieves referred to in the art as ZSM zeolites such as ZSM-5 and ZSM-11. ZSM zeolites are described in the previously cited U.S. Pat. No. 4,818,369 which is incorporated herein for this description.

The preferred NZMS-based catalyst dewaxes the feed by selective isomerization of long chain paraffins rather than by cracking of the paraffins as done by some other molecular sieves. This results in the subject process producing less light hydrocarbon by-products and providing higher yields of middle distillate products.

Non-zeolitic molecular sieves (NZMS) materials contain framework tetrahedral units ($TO_2$) of aluminum ($AlO_2$), phosphorus ($PO_2$) and at least one additional element EL ($ELO_2$). Non-zeolitic molecular sieves include the "ELAPSO" molecular sieves as disclosed in U.S. Pat. No. 4,793,984 (Lok et al.), "SAPO" molecular sieves of U.S. Pat. No. 4,440,871 (Lok et al.) and crystalline metal aluminophosphates—MeAPOs where "Me" is at least one of Mg, Mn, Co and Zn—as disclosed in U.S. Pat. No. 4,567,029 (Wilson et al.). Framework As, Be, B, Cr, Fe, Ga, Ge, Li, Ti or V and binary metal aluminophosphates are disclosed in various species patents.

Also relevant to the present invention is U.S. Pat. No. 4,758,419 (Lok et al.), which discloses MgAPSO non-zeolitic molecular sieves and which is incorporated herein by reference. MgAPSO sieves have a microporous crystalline framework structure of $MgO_2^{-2}$, $AlO_2^{-}$, $PO_2^{+}$, and $SiO_2$ tetrahedral units having an empirical chemical composition on an anhydrous basis expressed by the formula:

$$mR:(Mg_wAl_xP_ySi_z)O_2$$

wherein "R" represents at least one organic templating agent present in the intracrystalline pore system; "m" represents the molar amount of "R" present per mole of $(Mg_wAl_xP_ySi_z)O_2$ and has a value of zero to about 0.3; and "w", "x", "y" and "z" represent the mole fractions of element magnesium, aluminum, phosphorus and silicon, respectively, present as tetrahedral oxides. The mole fraction of each framework constituent of the NZMS is defined as a compositional value which is plotted in phase diagrams of U.S. Pat. No. 4,758,419. The mole fractions "w", "x", "y" and "z" are generally defined as being within the limiting compositional values set out therein.

The nomenclature employed herein to refer to the members of the class of MgAPSOs is consistent with that employed in the aforementioned patents. A particular member of a class is generally referred to as a "-n" species wherein "n" is an integer, e.g., MgAPSO-11, MgAPSO-31 and MgAPSO-41. The especially preferred species of the present invention is MgAPSO-31 having a characteristic X-ray powder diffraction pattern which contains at least the d-spacings set forth below:

| 2θ | d | Relative Intensity |
|---|---|---|
| 8.4–9.501 | 10.53–9.3084 | w – s |
| 20.2–20.4 | 4.40–4.35 | m |
| 22.0–22.1 | 4.04–4.022 | m |
| 22.5–22.7 | 3.952–3.92 | vs |
| 23.15–23.35 | 2.831–2.814 | w – m |

The distillate dewaxing catalyst is preferably prepared by combining the NZMS material with an inorganic oxide support material suitable for formation of catalyst particles. The support material should be highly porous and have a surface area of about 25 to about 500 $m^2/g$, uniform in composition and relatively refractory to the conditions utilized in the hydrocarbon conversion process. The catalyst may comprise a variety of support materials which have traditionally been utilized in hydrocarbon conversion catalysts such as: (1) refractory inorganic oxides including alumina, titanium dioxide, zirconium dioxide, chromium oxide, zinc oxide, magnesia, thoria, boria, silica-alumina, silica-magnesia, chromia-alumina, alumina-boria, silica-zirconia, etc.; (2) silica or silica gel, clays and silicates including those synthetically prepared and naturally occurring, which may or may not be acid treated, for example attapulgus clay, diatomaceous earth, fuller's earth, kaolin, kieselguhr, etc.; and, (3) combinations of materials from one or more of these groups.

The preferred support materials are refractory inorganic oxides, most preferably alumina. Suitable aluminas are the crystalline aluminas known as the gamma-, eta-, and theta-aluminas. Excellent results are obtained with a matrix of substantially pure gamma-alumina. Whichever type of matrix is employed, it may be activated prior to use by one or more treatments including but not limited to drying, calcination, and steaming.

The dewaxing catalyst may contain a positive amount of a metal hydrogenation component. Unless otherwise specified the concentration of any metal component of a catalyst described herein is intended to indicate the amount of metal present in terms of the elemental metal as compared to a sulfide or oxide. The metal hydrogenation component may comprise a Group VIII metal such as nickel or cobalt. A preferred metal component for the dewaxing catalyst is a base metal chosen from the group consisting of nickel, tungsten and molybdenum or a mixture of one of these metals. It is, however, contemplated that ruthenium may be a suitable sulfur resistant metal component for the dewaxing catalyst when used at a low metal component level. Platinum and/or palladium can also be employed as the metal component. The metal component of the dewaxing catalyst may exist within the final catalyst composite as a compound such as an oxide, sulfide, halide, oxysulfide, etc., or as an elemental metal or in combination with one or more other ingredients of the catalytic composition. It is presently preferred to employ a base metal component which exists in a fully sulfided state. The metal hydrogenation component is preferably present at a concentration of from about 0.01 to about 0.5 mass % of the NZMS component of the dewaxing catalyst, calculated on an elemental basis.

The finished dewaxing catalysts should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/g$ are greatly preferred.

In the subject process the dewaxing zone is operated at hydrodewaxing conditions which include a pressure of about 25 to 150 atmospheres, a temperature of about 250 to 500° C., liquid hourly space velocities of from about 0.1 to 100 $hr^{-1}$, and hydrogen-to-hydrocarbon molar ratios of from about 0.1 to 10.

An alumina component of the two catalysts used in the process may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The composition and physical characteristics of the two catalysts such as shape and surface area are not considered to be limiting upon the utilization of the present invention. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of a fluidized or ebulated bed reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in either upward or downward flow. The reaction zones therefore do not need to be fixed bed systems as depicted on the Drawing.

The catalyst particles may be prepared by any known method in the art including the well-known oil drop and extrusion methods. A preferred form for the catalysts used in the subject process is an extrudate. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

A spherical catalyst may be formed by use of the oil dropping technique such as described in U.S. Pat. Nos. 2,620,314; 3,096,295; 3,496,115 and 3,943,070 which are incorporated herein by reference. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to the catalysts before or during the forming of the catalyst particles, but the hydrogenation components of the dewaxing catalyst are preferably composited with the formed support by impregnation after the active component and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles.

Hydrogenation components contemplated for use in the two catalysts are those catalytically active components selected from the Group VIB and Group VIII metals and their compounds. References herein to Groups of the Periodic Table are to the traditionally American form as reproduced in the fourth edition of *Chemical Engineer's Handbook,* J. H. Perry editor, McGraw-Hill, 1963. Generally, the amount of hydrogenation components present in the final catalyst composition is small compared to the quantity of the other above-mentioned support components. The hydrogenation components contemplated for inclusion in the catalysts used in the process include one or more metals chosen from the group consisting of molybdenum, tungsten, chromium, iron, cobalt, nickel, platinum, palladium, iridium, osmium, rhodium, ruthenium and mixtures thereof. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the aromatics saturation catalyst. If used phosphorus is normally present in the catalyst in the range of 1 to 30 wt. % and preferably 3 to 15 wt. % calculated as $P_2O_5$.

Hydroprocessing to effect the hydrogenation of aromatic compounds boiling in the diesel fuel or kerosene boiling ranges is a well established commercial process. A study of the conditions useful in the saturation of diesel fuel aromatics, the effects of varying these conditions on product properties and other factors in using a specific commercially available hydrogenation catalyst is presented in an article at page 47 of the May 29, 1989 edition of the *Oil and Gas Journal.* A second article on the production of low aromatic hydrocarbon diesel fuel is presented at page 109 of the May 7, 1990 edition of the *Oil and Gas Journal.* These articles are incorporated herein by reference for their teaching in regard to the hydrogenation of middle distillates.

As the aromatics saturation zone lies downstream of the dewaxing zone, the conditions employed in the aromatics saturation zone are greatly affected by the conditions employed in the dewaxing zone. As the two zones are interconnected or possibly located within the same vessel, the pressure to the aromatics saturation zone will normally be essentially equal to the pressure of the dewaxing zone.

If desired, additional hydrogen can be added between the reaction zones. The temperature of the inlet stream to the aromatics saturation zone is preferably lower than the inlet temperature to the dewaxing zone. In the subject invention, this is primarily achieved by admixing the portion of the process feed stream and hydrogen which is bypassed around the dewaxing zone into the effluent of the dewaxing zone. This material is preferably not heated by any means such as indirect heat exchange or a fired heater which raises the temperature of the process streams derived from the separation zone to the inlet temperature of the dewaxing zone.

The reactants flowing through the dewaxing zone may be heated by exothermic reactions performed in the dewaxing zone. However, the desired inlet temperature to the aromatics saturation zone is 50 Fahrenheit degrees lower than the inlet temperature to the dewaxing zone. Preferably the inlet temperature of the downstream reaction zone is 75 Fahrenheit degrees cooler, and more preferably the inlet temperature to the aromatic saturation zone is about 100 Fahrenheit degrees lower than the inlet temperature to the dewaxing zone.

The pressure maintained in the aromatics hydrogenation reaction zone is preferably within the broad range of about 400 to 2250 psia (2758–15510 kpa). The aromatics saturation zone is preferably operated with a hydrogen to hydrocarbon ratio of about 5,000 to 18,000 standard cubic feet of hydrogen per barrel of feedstock (889 to 3200 standard meter$^3$ per meter$^3$). The aromatics saturation zone may be operated at an inlet temperature of about 450 to 620 degrees F. (232–327 degrees C.).

The catalyst employed in the aromatics saturation zone may in many ways resemble that employed in the dewaxing zone. That is, it may have the same overall size and shape as the dewaxing catalyst and contain many of the same ingredients. Aromatics saturation or hydrogenation catalysts however typically do not contain zeolitic materials or molecular sieve materials and often comprise only one or more metals on an amorphous alumina. Much of the technology involved with the aromatics hydrogenation catalyst is centered upon the identity and amount of the metals in the catalyst, the methods chosen for the impregnation of the metals into the catalyst, the pore structure and distribution of the alumina and the overall geometry of the catalyst particle.

The hydrogenation catalyst will typically comprise a base metal hydrogenation component chosen from nickel, cobalt, molybdenum and tungsten and possibly other promoters such as phosphorous supported on an inorganic oxide catalyst. The hydrogenation metal(s) usually are present at a concentration based upon the finished catalyst equal to about to 2 to about 12 wt. % measured as the common metal oxide. The cross-sectional diameter of the catalyst particles is usually from about 1/40 to about 1/8 inch and preferably about 1/32 to about 1/12 inch.

The total pore volume of the aromatics saturation catalyst should be within the broad range of about 0.2 to about 1.0 cc per gram and preferably between about 0.25 to about 0.7 cc per gram. The finished catalyst should have a surface area greater than about 100 meters per gram and preferably between about 100 and 300 meters per gram as measured by mercury porosity. The inventive concept resides in the process flow rather than the catalyst composition described herein. Therefore, alternative catalyst compositions can be employed in both the dewaxing and aromatics hydrogenation zones of the subject invention.

The invention may be characterized as a process which comprises separating a distillate hydrocarbon fraction, in the presence of added hydrogen as required for the desired separation, into a first vapor phase process stream and a first liquid phase process stream in a first vapor/liquid separation zone; admixing hydrogen with the first liquid phase process stream and then separating the resulting admixture into a second vapor phase process stream and a second liquid phase process stream in a second vapor/liquid separation zone; passing the second vapor phase process stream into a catalytic dewaxing zone operated at catalytic hydrodewaxing conditions and thereby producing a catalytic dewaxing zone effluent stream; admixing the first vapor phase process stream and the second liquid phase process stream with the catalytic dewaxing zone effluent stream and producing a charge mixture having a lower temperature than the catalytic dewaxing zone effluent stream; passing said charge mixture into an aromatic hydrocarbon saturation zone operated at hydrogenation conditions which include a lower temperature than said catalytic hydrodewaxing conditions, and recovering a distillate product stream having a lower pour point and reduced aromatics content than said distillate hydrocarbon fraction. The amount of hydrogen required for the desired separation may range from zero to about 60 mole percent.

A limited embodiment of the invention may accordingly be characterized as a hydrotreating process which comprises admixing hydrogen into a hydrocarbon feed stream comprising diesel boiling range hydrocarbons and higher boiling PNA compounds and then separating the distillate hydrocarbon feed stream into a first vapor phase process stream and a first liquid phase process stream in a first separation zone; admixing additional hydrogen with the first liquid phase process stream and then separating the resulting admixture into a second vapor phase process steam comprising diesel boiling range hydrocarbons and a second liquid phase process stream comprising PNA compounds in a second separation zone; admixing hydrogen into the second vapor phase process steam and passing the second vapor phase process stream into a catalytic dewaxing zone operated at catalytic hydrodewaxing conditions and thereby producing a catalytic dewaxing zone effluent stream; admixing the first vapor phase process stream and the second liquid phase process stream with the catalytic dewaxing zone effluent stream and producing a charge mixture having a lower temperature than the catalytic dewaxing zone effluent stream; passing said charge mixture into an aromatic hydrocarbon saturation zone operated at hydrogenation conditions which include a lower temperature than said catalytic hydrodewaxing conditions and hydrogenating PNA compounds, and recovering a distillate product stream having a lower pour point and reduced aromatics content than said distillate hydrocarbon feed stream. The effluent of the aromatic saturation zone may be separately fractionated or may be passed into a separation zone which processes the effluent of a hydrocracking reaction zone and which produces a PNA-containing stream recycled to the hydrocracking reaction zone.

What is claimed:

1. A hydrotreating process which comprises:

a.) separating a distillate hydrocarbon fraction in a vapor/liquid separation zone in the presence of added hydrogen into a first vapor phase process stream comprising hydrocarbons boiling in the light diesel and kerosene boiling point ranges and a first liquid phase process stream comprising hydrocarbons boiling in the heavy diesel boiling point range;

b.) admixing hydrogen with the first liquid phase process stream to yield a second liquid phase process stream and then passing the second liquid phase process stream into a catalytic dewaxing zone operated at catalytic hydrodewaxing conditions and thereby producing a catalytic dewaxing zone effluent stream;

c.) admixing the first vapor phase process stream and the catalytic dewaxing zone effluent stream and producing a charge mixture having a lower temperature than the catalytic dewaxing zone effluent stream; and, d.) passing said charge mixture into an aromatic hydrocarbon saturation zone operated at hydrogenation conditions which include a lower temperature than said catalytic hydrodewaxing conditions, and recovering a distillate product stream having a lower pour point and reduced aromatics content than said distillate hydrocarbon fraction.

2. The process of claim 1 further characterized in that the catalytic dewaxing zone contains a dewaxing catalyst comprising a non-zeolitic molecular sieve (NZMS) material.

3. The process of claim 2 wherein the NZMS material is a MgAPSO.

4. The process of claim 2 wherein the NZMS material is a SAPO.

5. A hydrotreating process which comprises:

a.) separating a distillate hydrocarbon feed stream, in the presence of added hydrogen, into a first vapor phase process stream and a first liquid phase process stream in a first vapor/liquid separation zone;

b.) admixing hydrogen with the first liquid phase process stream and then separating the resulting admixture into a second vapor phase process stream and a second liquid phase process stream in a second vapor/liquid separation zone;

c.) passing the second vapor phase process stream into a catalytic dewaxing zone operated at catalytic hydrodewaxing conditions and thereby producing a catalytic dewaxing zone effluent stream;

d.) admixing the first vapor phase process stream and the second liquid phase process stream with the catalytic dewaxing zone effluent stream and producing a charge mixture having a lower temperature than the catalytic dewaxing zone effluent stream; and, e.) passing said charge mixture into an aromatic hydrocarbon saturation zone operated at hydrogenation conditions which include a lower temperature than said catalytic hydrodewaxing conditions, and recovering a distillate product having a lower pour point and lower aromatics content than said distillate hydrocarbon feed stream.

6. The process of claim 5 further characterized in that the second vapor phase process stream carries substantially all of the hydrogen passed into the catalytic dewaxing zone.

7. The process of claim 5 wherein the dewaxing zone contains a catalyst comprising an NZMS material.

8. A hydrotreating process which comprises:

a.) admixing hydrogen into a hydrocarbon feed stream comprising diesel boiling range hydrocarbons and higher boiling polynuclear aromatic (PNA) compounds and then separating the distillate hydrocarbon feed stream into a first vapor phase process stream and a first liquid phase process stream in a first separation zone;

b.) admixing additional hydrogen with the first liquid phase process stream and then separating the resulting admixture into a second vapor phase process steam comprising diesel boiling range hydrocarbons and a second liquid phase process stream comprising PNA compounds in a second separation zone;

c.) admixing hydrogen into the second vapor phase process steam and passing the second vapor phase process stream into a catalytic dewaxing zone operated at catalytic hydrodewaxing conditions and thereby producing a catalytic dewaxing zone effluent stream;

d.) admixing the first vapor phase process stream and the second liquid phase process stream with the catalytic dewaxing zone effluent stream and producing a charge mixture having a lower temperature than the catalytic dewaxing zone effluent stream;

e.) passing said charge mixture into an aromatic hydrocarbon saturation zone operated at hydrogenation conditions which include a lower temperature than said catalytic hydrodewaxing conditions and hydrogenating PNA compounds; and, f.) recovering a distillate product stream having a lower pour point and reduced aromatics content than said distillate hydrocarbon feed stream.

9. The process of claim 8 wherein the amount of hydrogen admixed into the first liquid phase process stream is controlled to adjust the separation performed in the second separation zone.

10. The process of claim 9 further including adjusting the rate at which hydrogen is admixed into the distillate hydrocarbon feed to control the separation of the distillate hydrocarbon feed into the first vapor and liquid process streams.

11. The process of claim 8 wherein the hydrocarbon feed stream is derived from the effluent of a hydrocracking reaction zone, and the effluent of the aromatic hydrocarbon saturation zone is separated in a separation zone which produces a stream recycled to the hydrocracking reaction zone.

* * * * *